US011866899B2

(12) United States Patent
Chiu et al.

(10) Patent No.: US 11,866,899 B2
(45) Date of Patent: Jan. 9, 2024

(54) TAILORING YEARN SYSTEM HAVING A TAILORING MECHANISM

(71) Applicant: Tunghai University, Taichung (TW)

(72) Inventors: Kuo-wei Chiu, Taichung (TW); Davina Doras Cranstoun, New Taipei (TW)

(73) Assignee: TUNGHAI UNIVERSITY, Taichung (TW)

( * ) Notice: Subject to any disclaimer, the term of this patent is extended or adjusted under 35 U.S.C. 154(b) by 78 days.

(21) Appl. No.: 17/587,826

(22) Filed: Jan. 28, 2022

(65) Prior Publication Data

US 2023/0228054 A1 Jul. 20, 2023

(30) Foreign Application Priority Data

Jan. 17, 2022 (TW) ..... 111101791

(51) Int. Cl.
*E02B 3/10* (2006.01)
*E03F 1/00* (2006.01)

(52) U.S. Cl.
CPC . *E02B 3/10* (2013.01); *E03F 1/00* (2013.01)

(58) Field of Classification Search
CPC ..... E02B 3/10; E02B 3/04; E02B 3/06; E02B 3/062; E02B 3/14
See application file for complete search history.

(56) References Cited

U.S. PATENT DOCUMENTS 283,683 A * 8/1883 Thomas ..... E02B 3/062 405/26
1,137,049 A * 4/1915 Callahan ..... E02B 3/06 405/34
3,908,384 A * 9/1975 Frey ..... E02B 3/06 405/30
3,913,333 A * 10/1975 Hubbard, Jr. ..... E02B 3/06 405/31
4,341,489 A * 7/1982 Karnas ..... E02B 3/046 405/35
4,560,304 A * 12/1985 Jenkins ..... E02B 3/04 405/74
4,801,220 A * 1/1989 Bores ..... E02B 3/06 405/33
4,804,294 A * 2/1989 Barthel ..... E02B 3/06 405/35

(Continued)

*Primary Examiner* — Benjamin F Fiorello
(74) *Attorney, Agent, or Firm* — Guice Patents PLLC

(57) ABSTRACT

A triadic recurve implosion flood navigation for in-situ tailoring yearn system—[TRINITY-D20] has a tailoring mechanism comprising a first unit having an arc-shaped first arcuate portion, and a second unit having an arc-shaped second arcuate portion, the first and second units stagger each other with concave arcuate surfaces facing opposite directions by center axes of curvature of the first and second arcuate portions parallelling each other to cause an arcuate end of the first arcuate portion locate between two arcuate ends of the second arcuate portion and separated from the concave arcuate surface of the second arcuate portion by a first distance, and to cause an arcuate end of the second arcuate portion locate between two arcuate ends of the first arcuate portion and separated from the first arcuate portion by a second distance, thereby the first and second arcuate portions jointly define a curved channel.

27 Claims, 9 Drawing Sheets

(56) References Cited

U.S. PATENT DOCUMENTS

| | | | | | |
|---|---|---|---|---|---|
| 5,129,756 | A * | 7/1992 | Wheeler | E02B 3/06 | 405/23 |
| 5,556,230 | A * | 9/1996 | Turk | E02B 3/129 | 405/21 |
| 5,857,805 | A * | 1/1999 | Chappell | E02B 3/02 | 405/15 |
| 5,895,174 | A * | 4/1999 | Beaver | E02B 3/04 | 405/35 |
| 6,213,682 | B1 * | 4/2001 | Karnas | E02B 3/046 | 405/35 |
| 9,151,008 | B1 * | 10/2015 | Carstens | E02B 3/04 | |
| 2009/0052989 | A1 * | 2/2009 | Bonilla Gris | F15D 1/12 | 405/21 |
| 2014/0270963 | A1 * | 9/2014 | Lopez | E02B 3/06 | 405/35 |

* cited by examiner

TAILORING YEARN SYSTEM HAVING A TAILORING MECHANISM

BACKGROUND OF THE INVENTION

Field of Invention

The invention is related to a technology for providing resilience to flood, more particularly to a triadic recurve implosion flood navigation for in-situ tailoring yearn system—[TRINITY-D20].

Related Art

Seasonal hurricanes, or more frequent extreme climate, often bring excess precipitation, which, if not drained in time, can accumulate and converge into a flood over time. In the construction and layout of city, there is usually not much reserved space for the free flow or circulation of catastrophic heavy rain or flood, which makes it more difficult to effectively drain a sudden flood.

Moreover, if the city is located in the coastal area, melting of icebergs due to global warming will raise sea levels, which may lead to flooding in low-lying areas of the city, severe erosion of beaches and sea cliffs, and intrusion of sea salt into aquifers.

In addition, flood can carry plastic waste and even highly polluting or dangerous chemical products into the sea, causing rapid algae growth, ocean pollution and acidification. And, flood will also take away a large amount of soil on the earth's surface, making the land barren, destroying vegetation, and deteriorating ecology, which will eventually lead to severe desertification.

It is particularly pointed out that since Saint Christopher and Nevis is located in the Caribbean Sea, based on its geographical location and hydrological characteristics, it is necessary to deal with the above-mentioned problems with corresponding measures, providing regular and sustained water resources management strategies will help fundamentally mitigate or reduce the occurrence of disasters.

In addition, with the development of social economy and the increase of human development and engineering activities, the natural ecological environment and biodiversity have been changed, especially the replenishment rate of groundwater has dropped significantly, and groundwater resources are also over-exploited and polluted, resulting in rapid decreasing of available groundwater.

SUMMARY OF THE INVENTION

Therefore, a main object of the invention is to provide a triadic recurve implosion flood navigation for in-situ tailoring yearn system—[TRINITY-D20] capable of guiding a travel direction of a flood in order to mitigate or reduce disasters caused by the flood.

In order to achieve the above-mentioned object, the triadic recurve implosion flood navigation for in-situ tailoring yearn system—[TRINITY-D20] provided by the invention has a tailoring mechanism, the tailoring mechanism comprises a first unit and a second unit, wherein the first unit has an arc-shaped first arcuate portion, the second unit has an arc-shaped second arcuate portion, the first unit and the second unit stagger each other with concave arcuate surfaces facing toward opposite directions by a center axis of curvature of the first arcuate portion parallelling to a center axis of curvature of the second arcuate portion to cause an arcuate end of the first arcuate portion locate between two arcuate ends of the second arcuate portion and separated from the concave arcuate surface of the second arcuate portion by a first distance, and to cause an arcuate end of the second arcuate portion locate between two arcuate ends of the first arcuate portion and separated from the first arcuate portion by a second distance, thereby the first arcuate portion and the second arcuate portion jointly define a curved channel between each other.

In one embodiment, the first arcuate portion has a plurality of first columns, and the first columns are spaced apart from one another and arranged in an arcuate shape of the first arcuate portion; the second arcuate portion has a plurality of second columns, and the second columns are spaced apart from one another and arranged in an arcuate shape of the second arcuate portion.

Wherein, each of the first columns and each of the second columns are respectively quadrilateral in cross-sectional shape in a radial direction, preferably trapezoidal.

On the other hand, the triadic recurve implosion flood navigation for in-situ tailoring yearn system—[TRINITY-D20] provided by the invention further has a flood guiding array, and the flood guiding array comprises a plurality of the tailoring mechanisms.

In one embodiment, the tailoring mechanisms are equidistantly disposed with a virtual center point as a center within a predetermined radius range with the center point as the center, and one end of the curved channel of each of the tailoring mechanisms is radially close to the center point, and another end is away from the center point.

In one embodiment, a quantity of the tailoring mechanism is three.

Further, a minimum distance between one end of any two of the adjacent second arcuate portions of the tailoring mechanisms close to the center point is a third distance.

In one embodiment, two ends of the curved channel are respectively defined as an inflow end and an outflow end, the tailoring mechanisms are arranged one by one sequentially, and between any two of the adjacent tailoring mechanisms, the outflow end of the tailoring mechanism preceding sequentially is connected in series with the inflow end of the subsequent tailoring mechanism.

In one embodiment, between any two of the adjacent tailoring mechanisms, one end of the second arcuate portion of the tailoring mechanism preceding sequentially located at another end of an arcuate shape of the outflow end is located in the curved channel of the subsequent tailoring mechanism, and one end of the first arcuate portion of the subsequent tailoring mechanism located at another end of an arcuate shape of the inflow end is located in the curved channel of the tailoring mechanism preceding sequentially, and the curved channel of the tailoring mechanism preceding sequentially and the curved channel of the subsequent tailoring mechanism are partially overlapped and communicated with each other.

In one embodiment, a minimum distance between any two of the adjacent tailoring mechanisms is a fourth distance.

DETAILED DESCRIPTION OF THE INVENTION

Figure 1:
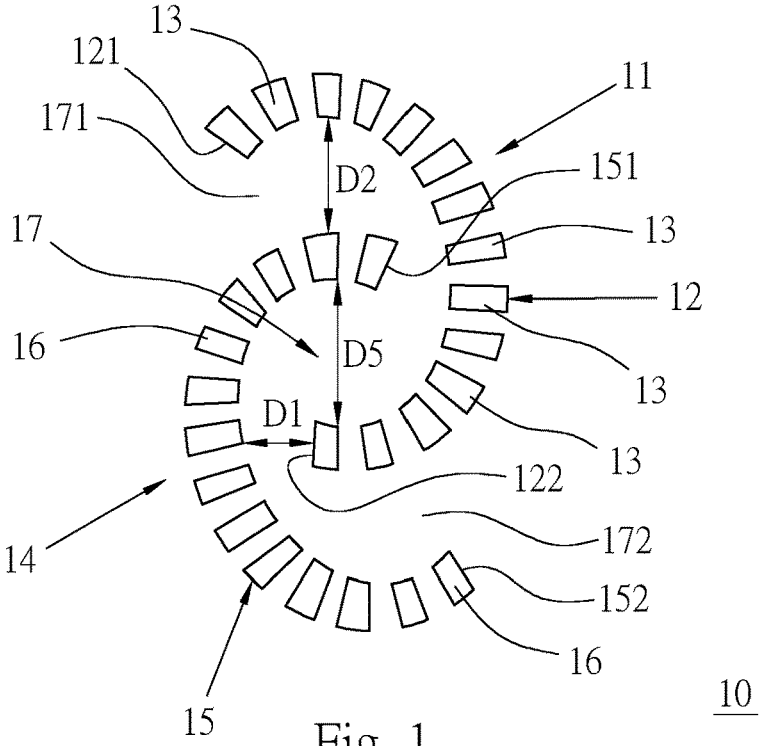
FIG. 1 is a schematic diagram of a first embodiment of the invention.

Please refer to FIG. 1 for a triadic recurve implosion flood navigation for in-situ tailoring yearn system—[TRINITY-D20] disclosed in a first embodiment of the invention mainly comprising a tailoring mechanism 10 for disposing in a coast or a river bank and capable of providing resilience to a flood by guiding a travel direction, increasing a flow path length, and prolonging a water flow time of the flood, thereby slowing down a flow rate and dispersing a flow volume in order to reduce a severity of the flood.

Wherein, identification of biological functions and bionic design and development of biological structures for the tailoring mechanism 10 was first carried out and completed independently by Professor CHIU Kuo-Wei from the Department of Architecture of Tunghai University, and then was delivered to graduate students to instruct them to carry out the structural design test and functional design confirmation of the triadic recurve in-situ flood navigation array of model TRINITY—D20™. In particular, the design idea of the tailoring mechanism 10 of the invention is derived from guard cells with elastic inner walls of different thicknesses at different positions expanding unevenly due to the presence of air, and forming an osmotic pressure (vapor pressure difference) between the two for gas exchange.

Specifically, the tailoring mechanism 10 comprises a first unit 11 and a second unit 14, wherein the first unit 11 has an arc-shaped first arcuate portion 12, and two arcuate ends of the first arcuate portion 12 are respectively defined as a first end 121 and a second end 122. In this embodiment, the first arcuate portion 12 has a plurality of first columns 13, and the first columns 13 are spaced apart from one another and arranged in an arcuate shape of the first arcuate portion 12.

The second unit 14 has an arc-shaped second arcuate portion 15, and two arcuate ends of the second arcuate portion 15 are respectively defined as a first end 151 and a second end 152. In this embodiment, the second arcuate portion 15 has a plurality of second columns 16, and the second columns 16 are spaced apart from one another and arranged in an arcuate shape of the second arcuate portion 15.

Figure 1A:
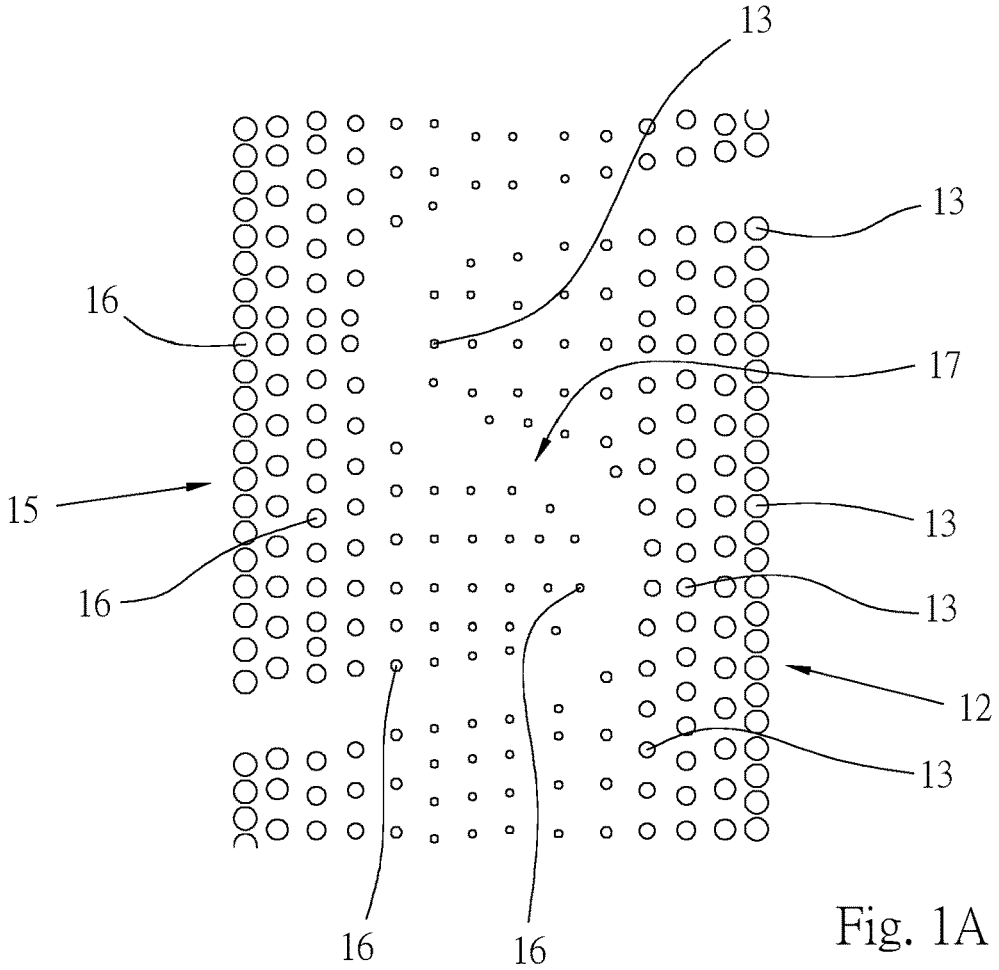
FIG. 1A is a schematic diagram of another embodying mode of an arcuate portion according to the first embodiment of the invention.

Wherein, each of the first columns 13 and each of the second columns 16 are respectively quadrilateral in cross-sectional shape in a radial direction, preferably trapezoidal. In addition, length, width, height, structural shape, quantity, and positional relationship of the columns can be set according to a size of a field disposed with the tailoring mechanism 10 or a predicted flood water level. For example, as shown in FIG. 1A, the columns comprised in each of the arcuate portions are arranged in an array, the array can be N columns and M rows, N and M are natural numbers, and height, width (length) of the columns, and density of arrangement of the columns are gradually decreasing from the outside to the inside toward a center of curvature of the arcuate shape, so that a fluid flowing through the columns can be guided to a specific direction.

In addition, since the columns comprised in each of the arcuate portions are spaced apart from one another, each of the arcuate portions has a plurality of gaps, when the fluid flows through each of the arcuate portions, the fluid can be vented out through the gaps to facilitate evacuation of the fluid.

Further, a large number of hydrophilous plants can further be planted on a land disposed with the tailoring mechanism 10. In addition to increasing a moisture content of the soil, the plants can also be used to provide shade from the sun so that the soil can be maintained at an appropriate temperature to reduce evapotranspiration in the soil.

Furthermore, in other embodiments, the tailoring mechanism 10 can be disposed in an intertidal zone or a neritic zone to divide the waters into a plurality of blocks, which can not only slow down coastal erosion, but also create habitats for fish or marine life.

In addition, curvature, arc length, thickness and shape of the first arcuate portion 12 and the second arcuate portion 15 can be adjusted according to actual needs, such as the first arcuate portion 12 and the second arcuate portion 15 in this embodiment are respectively C-shaped, and in other embodying modes, the first arcuate portion 12 or the second arcuate portion 15 can be shaped with a thick middle part, and two gradually thinned sides extending from the middle part.

As shown in FIG. 1, the first unit 11 and the second unit 14 stagger each other with concave arcuate surfaces facing toward opposite directions by a center axis of curvature of the first arcuate portion 12 parallelling to a center axis of curvature of the second arcuate portion 15 to cause the second end 122 of the first arcuate portion 12 locate between two arcuate ends (i.e., the first end 151 and the second end 152) of the second arcuate portion 15, and the second end 122 of the first arcuate portion 12 separated from the concave arcuate surface of the second arcuate portion 15 by a first distance D1, and to cause the first end 151 of the second arcuate portion 15 locate between two arcuate ends (i.e., the first end 121 and the second end 122) of the first arcuate portion 12, a maximum distance between the first end 151 of the second arcuate portion 15 and the concave arcuate surface of the first arcuate portion 12 adjacent to the first end 121 being a second distance D2, and a maximum distance between the first end 151 of the second arcuate portion 15 and the concave arcuate surface of the first arcuate portion 12 adjacent to the second end 122 being separated by a holdup distance D5. Finally, the first arcuate portion 12 and the second arcuate portion 15 jointly define a curved channel 17 between each other, and two ends of the curved channel 17 are respectively defined as an inflow end 171 and an outflow end 172.

Wherein, ratio or size relationship between the first distance D1, the second distance D2 and the holdup distance D5 can be adjusted according to actual needs, sizes of the distances can respectively determine widths of parts of the curved channel 17 corresponding to the distances. In particular, the second distance D2 can define a width of the inflow end 171 to determine an inflow flow rate. The holdup distance D5 can define a size of a holdup area in the curved channel 17 formed by the arcuate portions intersecting with each other to determine a vortex size formed by an external fluid flowing through the holdup area.

In addition, on the premise that curvature and size of each of the arcuate portions are the same, if a width of the inflow end 171 is equal to a width of the outflow end 172, the tailoring mechanism 10 can be defined as a symmetrical structure.

According to calculation and simulation results, the first distance D1 is between 0.1 in and 0.5 in, and the second distance D2 is 0.5 in.

With the composition of the above components, the main implementation steps of the first embodiment of the invention are as follows:

Firstly, an external fluid enters the curved channel 17 through the inflow end 171. At this time, a fluid pressure is high and its flow rate is relatively high. When there is another static fluid remaining in the curved channel 17, the external fluid will converge with the static fluid and flow together toward an interior of the curved channel 17. In this embodiment, the external fluid is a liquid mainly composed of water.

Then, when the external fluid flows through a connecting position between the first arcuate portion 12 and the second arcuate portion 15, since a bending direction of the concave arcuate surface of the second arcuate portion 15 is opposite to a bending direction of the concave arcuate surface of the first arcuate portion 12, a pressure generated by the external fluid concentrating on the connecting position will cause an implosion, and a large proportion of the external fluid will be vented out through the gaps between the columns, and the pressure will drop sharply.

Finally, the remaining external fluid flows along the curvature of the second arcuate portion 15, and its flow velocity gradually becomes slower, and slowly and calmly flows out to a designated area from the outflow end 172, or the remaining external fluid remains statically in the curved channel 17.

Figure 2:
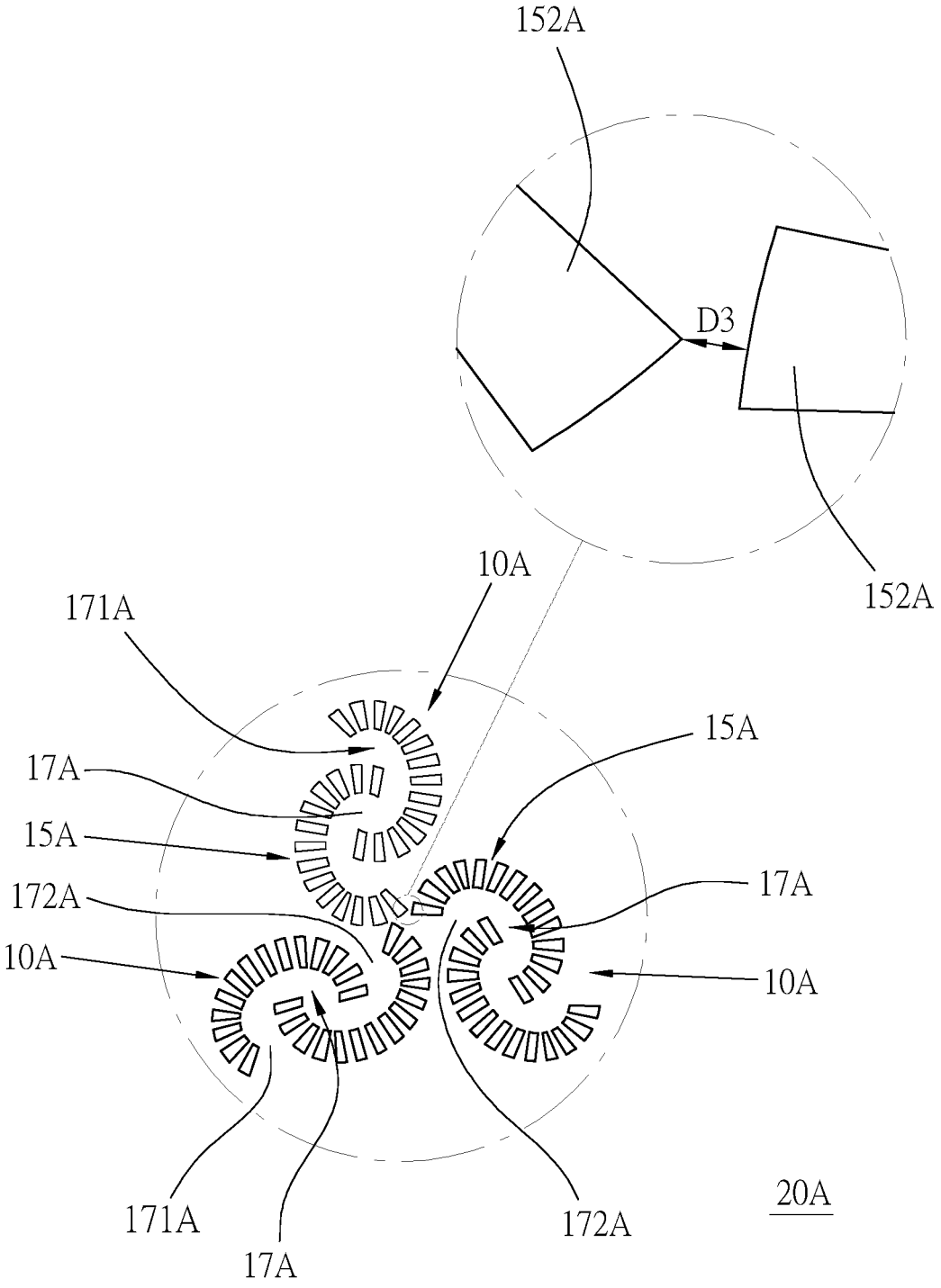
FIG. 2 is a schematic diagram of a second embodiment of the invention.

Please refer to a second embodiment of the invention shown in FIG. 2, a main difference between the second embodiment and the first embodiment is that the triadic recurve implosion flood navigation for in-situ tailoring yearn system—[TRINITY-D20] in this embodiment has a flood guiding array 20A, the flood guiding array 20A comprises three of the tailoring mechanisms 10A, wherein the tailoring mechanisms 10A are radially equidistantly disposed with a virtual center point as a center within a predetermined radius range with the center point as the center, and the outflow end 172A of the curved channel 17A of each of the tailoring mechanisms 10A is close to the center point, and the inflow end 171A is away from the center point.

In addition, a minimum distance between the two adjacent second ends 152A of the second arcuate portions 15A of the tailoring mechanisms 10A is a third distance D3, preferably, the third distance D3 is 0.5 in, so that there is an appropriate buffer space between the tailoring mechanisms 10A to achieve a better flow effect.

Figure 3:
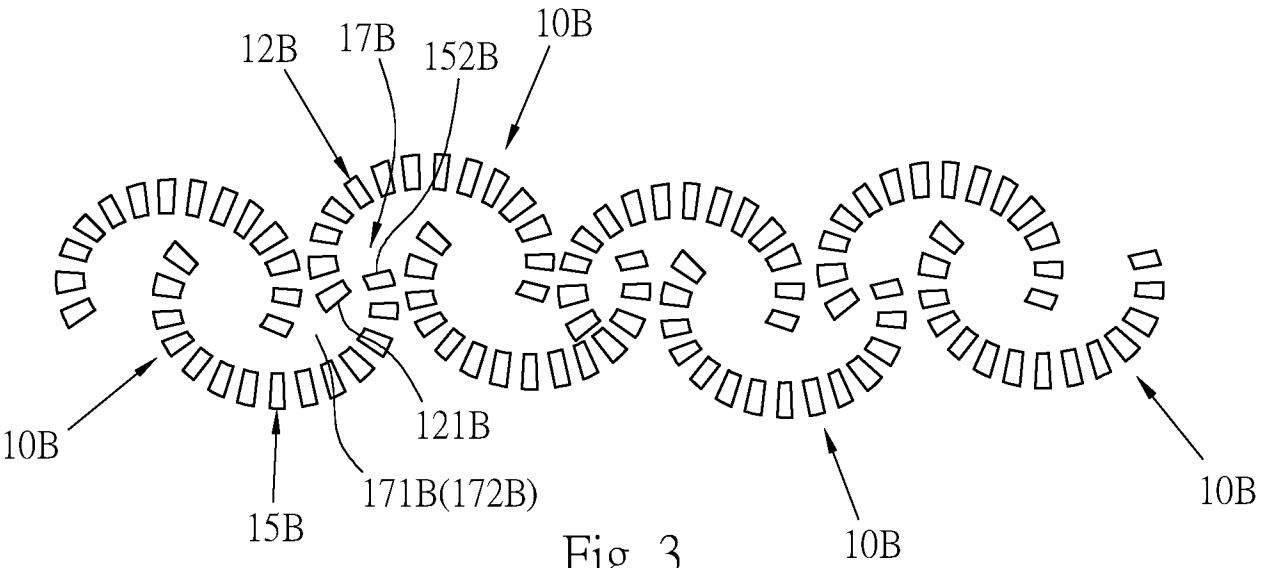
FIG. 3 is a schematic diagram of a third embodiment of the invention.

As shown in FIG. 3, a main difference between a third embodiment of the invention and the second embodiment is that the flood guiding array 20B comprises a plurality of the tailoring mechanisms 10B, and the tailoring mechanisms 10B are arranged one by one in sequence, wherein between any two of the adjacent tailoring mechanisms 10B, the outflow end 172B of the tailoring mechanism 10B preceding sequentially is connected in series with the inflow end 171B of the subsequent tailoring mechanism 10B.

Specifically, between any two of the adjacent tailoring mechanisms 10B, one end of the second arcuate portion 15B of the tailoring mechanism 10B preceding sequentially located at another end (i.e., the second end 152B) of an arcuate shape of the outflow end 172B is located in the curved channel 17B of the subsequent tailoring mechanism 10B, and one end of the first arcuate portion 12B of the subsequent tailoring mechanism 10B located at another end (i.e., the first end 121B) of an arcuate shape of the inflow end 171B is located in the curved channel 17B of the tailoring mechanism 10B preceding sequentially, and the curved channel 17B of the tailoring mechanism 10B preceding sequentially and the curved channel 17B of the subsequent tailoring mechanism 10B are partially overlapped and communicated with each other. Accordingly, the external fluid can be caused to flow in the curved channels 17B of the tailoring mechanisms 10B that are arranged one by one in order to gradually slow down its flow rate.

Figure 4:
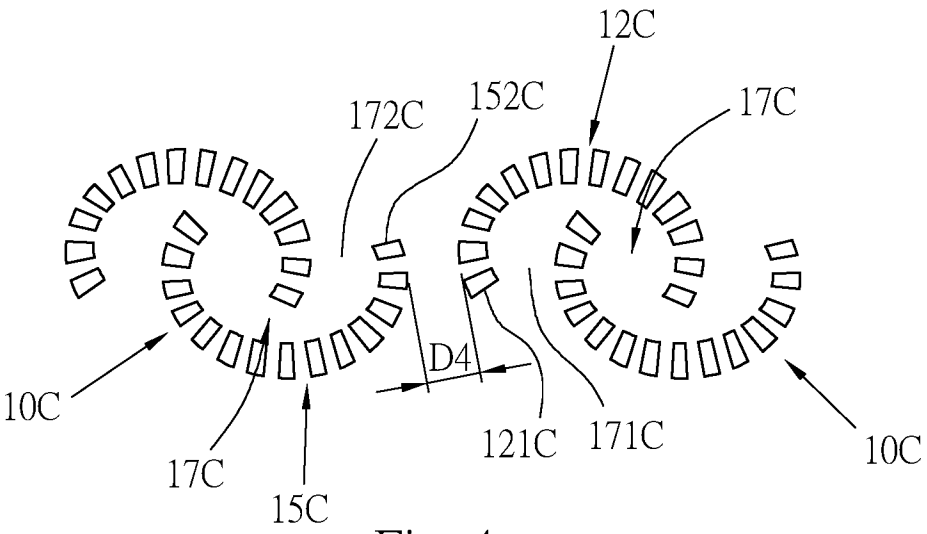
FIG. 4 is a schematic diagram of a fourth embodiment of the invention.

As shown in FIG. 4, a main difference between a fourth embodiment of the invention and the third embodiment is that between any two of the adjacent tailoring mechanisms 10C, a minimum distance between the second end 152C of the second arcuate portion 15C of the tailoring mechanism 10C preceding sequentially and the first end 121C of the first arcuate portion 127C of the subsequent tailoring mechanism 10C is a fourth distance D4 in order to achieve a better flow effect. In this embodiment, the fourth distance D4 is 0.5 in.

In addition, the invention can also be used in conjunction with another water conservancy facility to be capable of managing water resources or utilizing water conservancy under different climatic conditions or states. Wherein the water conservancy facility can be, but is not limited to, a rainwater collecting mechanism 30, a bridge water storage mechanism 40 or a road space tailoring mechanism 50, and the structural features of these mechanisms are described in detail below.

Figure 5A:
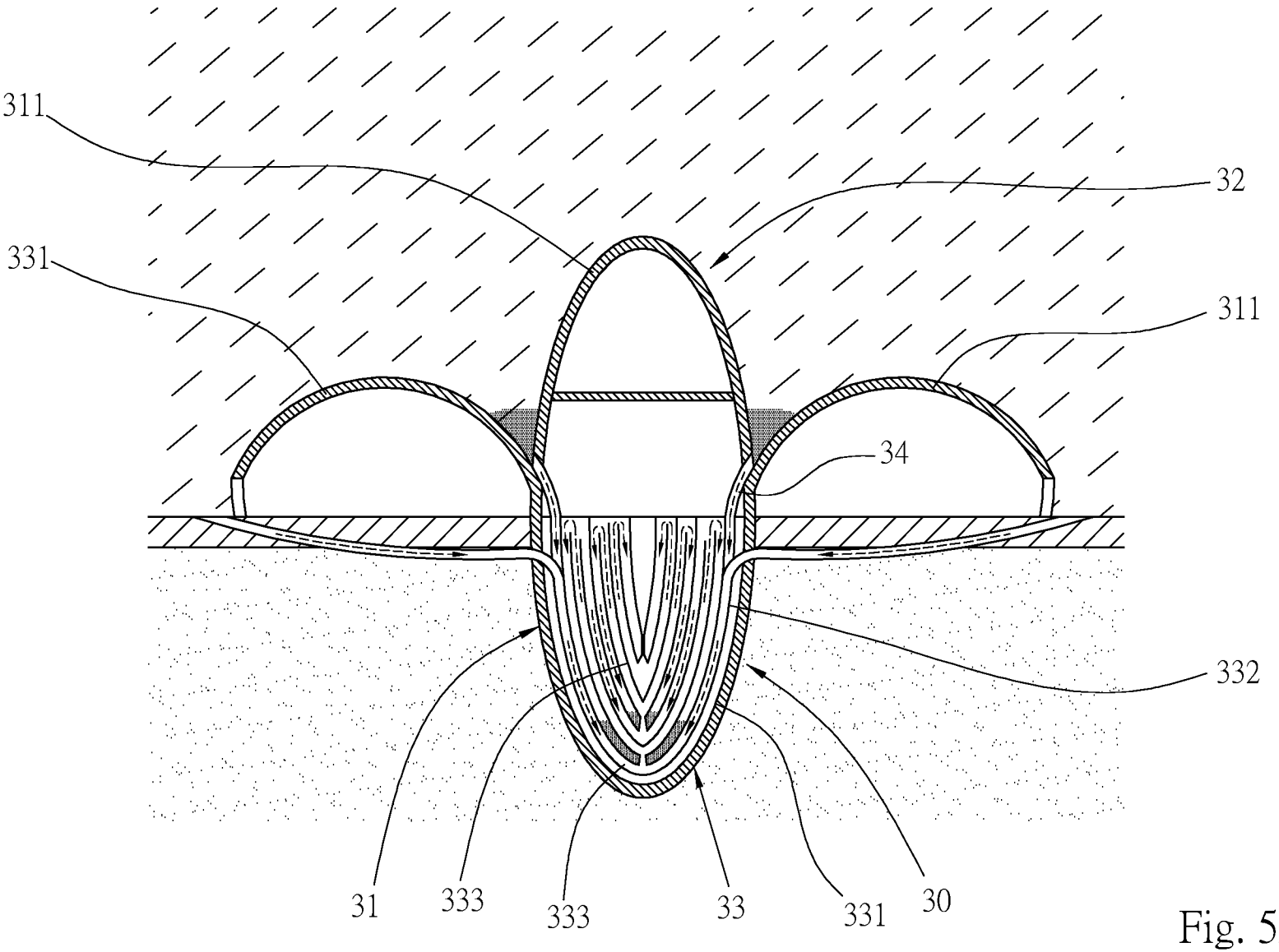
FIGS. 5A and 5B are schematic diagrams of different embodying modes of a rainwater collecting mechanism
Figure 5B:
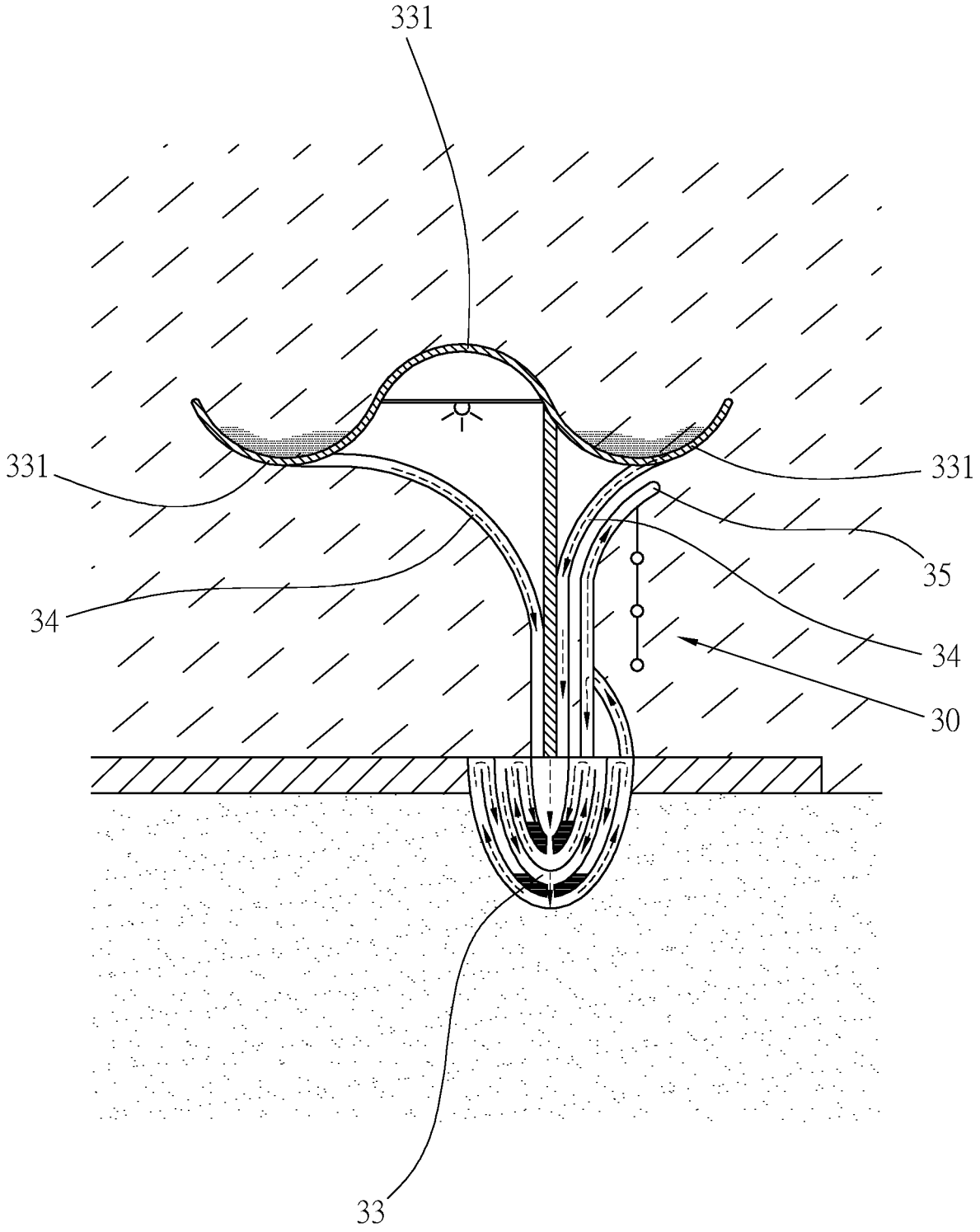

As shown in FIG. 5A and FIG. 5B, the rainwater collecting mechanism 30 has a main body 31, a collecting part 32 and a water storage part 33, wherein the main body 31 is in the form of a building, a part of which is buried under the ground, and another part is constructed on the ground. The collecting part 32 is disposed at a top of the building, so that the collecting part 32 is away from the ground, and the water storage part 33 is disposed inside the building, preferably, disposing in a basement of the building, or in a part below the ground.

Specifically, the collecting part 32 has a plurality of arcuate plates 311, each of the plates 311 is a modular nesting component, which can be assembled and combined with one another arbitrarily. For example, any two of the plates 311 are assembled with each other with convex arcuate surfaces facing outward (as shown in FIG. 5A), or connected with each other with the convex arcuate surface of one of the plates 311 facing outward and with a concave arcuate surface of the other plate 311 facing outward (as shown in FIG. 5B) to be used for guiding drainage or gathering rainwater respectively, and at the same time, the arcuate structures are capable of increasing a surface area for collecting rainwater.

Furthermore, the collecting part 32 and the water storage part 33 are connected with each other through a plurality of pipelines 34, so that the rainwater collected by the collecting part 32 can be distributed and stored in the water storage part 33 through the pipelines 34.

The water storage part 33 has a tank 331, inside the tank 331 is divided into a plurality of storage spaces 333 communicating with one another by a plurality of partitions 332, and the storage spaces 333 are arranged in the tank 331 in sequence from the outside to the inside. The storage spaces 333 receive the rainwater collected by the collecting part 32 through the pipelines 34 respectively, and the storage space 333 located at the outermost periphery receives the rainwater first, when that storage space 333 is full, the rainwater will overflow to the next storage space 333. Accordingly, the rainwater collecting mechanism 30 can be used as a water storage facility to improve the problem of water resources shortage.

In addition, the water storage part 33 is further connected with a drain pipe 35, when the storage spaces 333 are filled with the rainwater to the fullest, or when a water level is about to be full, the drain pipe 35 can be used to drain excess rainwater.

In particular, the design idea of the rainwater collecting mechanism 30 is derived from the shape of the leaves of pineapple.

Figure 6A:
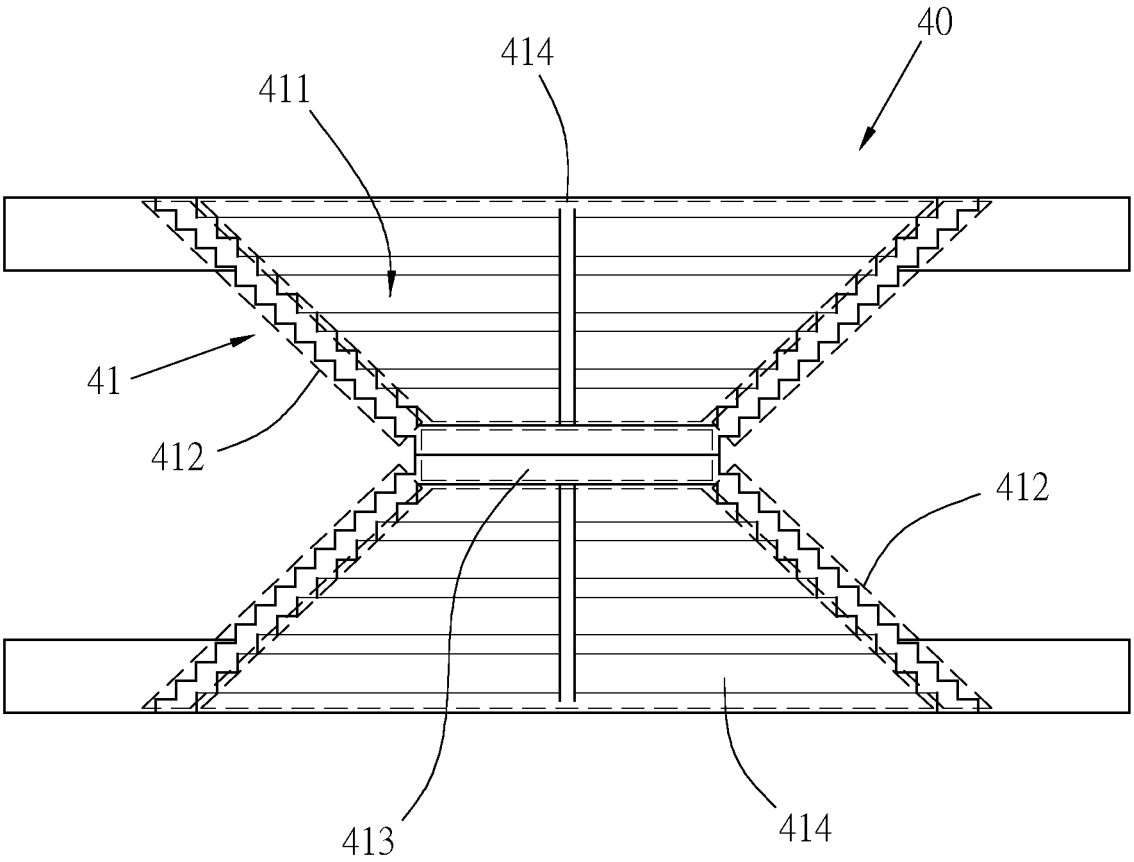
FIG. 6A is a schematic diagram of a bridge water storage mechanism.
Figure 6B:
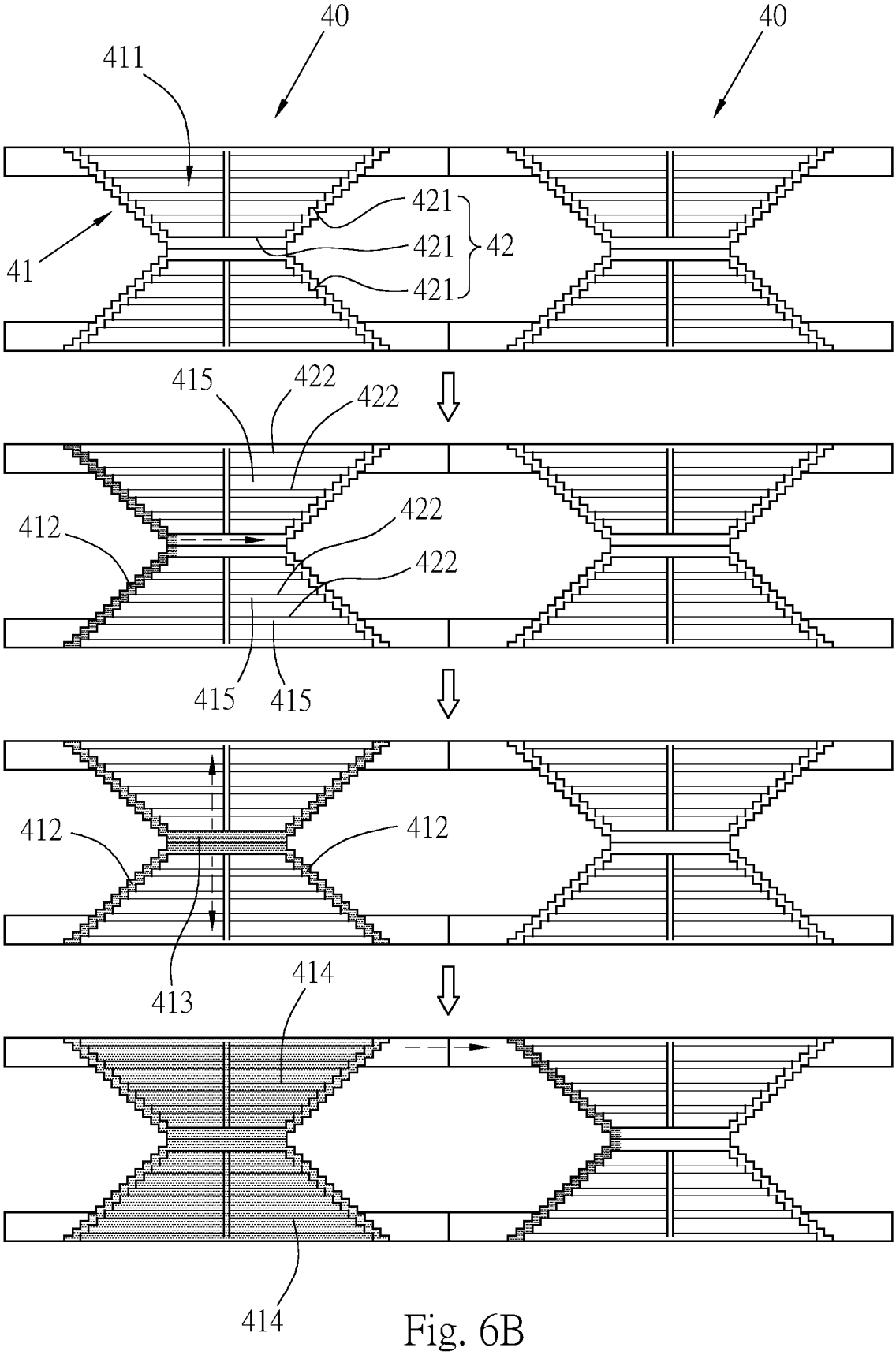
FIG. 6B is a schematic diagram related to FIG. 6A in a use situation, and showing two sets of the bridge water storage mechanisms.

As shown in FIG. 6A and FIG. 6B, the bridge water storage mechanism 40 has a column body 41 and a partition part 42, wherein the column body 41 is used for supporting bridges and road surface, and its configuration is designed according to a supporting capacity. In this embodiment, the column body 41 is in the shape of a hollow hourglass and has an inner space 411.

The partition part 42 has a plurality of first partitions 421 and a plurality of second partitions 422, wherein each of the first partitions 421 is respectively disposed in the column body 41 to divide the inner space 411 along a cross-section of the column body 41 in an axial direction into two outer ring areas 412, a connecting area 413 and two central areas 414. Each of the outer ring areas 412 is located at a position adjacent to peripheral walls on two sides of the column body 41, the connecting area 413 is spanned inside the column body 41, two ends thereof are respectively connected to each of the outer ring areas 412, and the connecting area 413 is located between the two central areas 414.

Furthermore, the second partitions 422 are separately disposed in each of the central areas 414, so that each of the central areas 414 is separated by a plurality of pipes 415 that communicate with one another and are parallel to one another. Wherein each of the pipes 415 can be designed with different widths and lengths.

Accordingly, as shown in FIG. 6B, two sets of the bridge water storage mechanisms 40 are juxtaposed. Wherein, when an external water body enters the bridge water storage mechanism 40, it is first filled in one of the two outer ring areas 412, after one of the two outer ring areas 412 is filled with the external water body to the fullest, the external water body flows into the other outer ring area 412 through the connecting area 413. Then, the external water body flows into the central areas 414 from the connecting area 413 respectively, and the external water body is gradually accumulated layer by layer by using the pipes 415 stacked on one another in each of the central areas 414 to achieve an object of water resources distribution and storage.

Finally, when one set of the bridge water storage mechanisms 40 is full of water, the water can flow into the other set of the bridge water storage mechanism 40 to accumulate and store more water resources.

In particular, the design idea of the bridge water storage mechanism 40 is derived from the xylem used to transport water in trees, wherein, when the tree is upright and functioning normally, the xylem is used to transport nutrients and water absorbed by the roots; however, when the tree is brought down and laid on its side, excess water is trapped in the trunk and builds up gradually.

Figure 7:
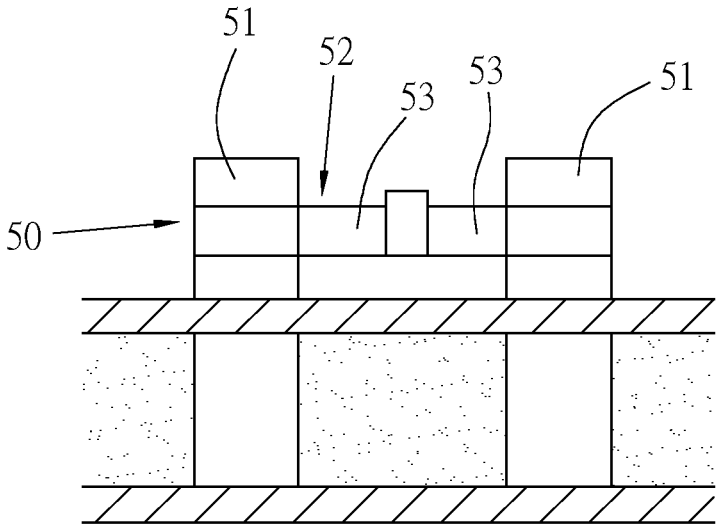
FIG. 7 is a schematic view of a road space tailoring mechanism, and showing a mode in a storage position.
Figure 11:
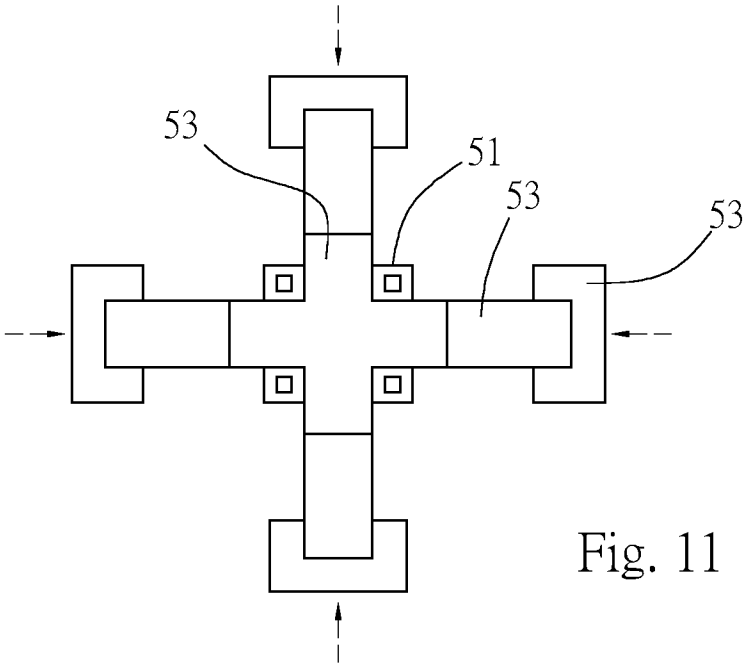
FIG. 11 is a partial top view of FIG. 10.
Figure 12:
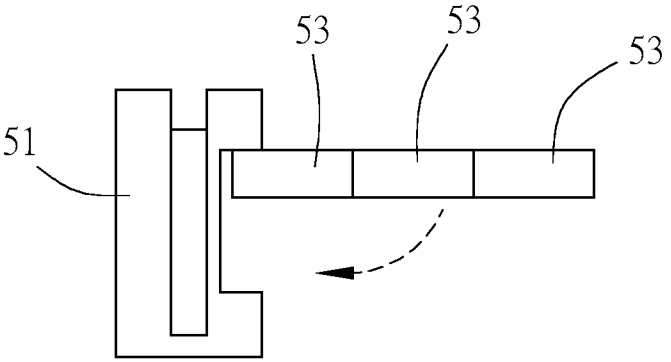
FIG. 12 is a partial side view of FIG. 11.
Figure 8:
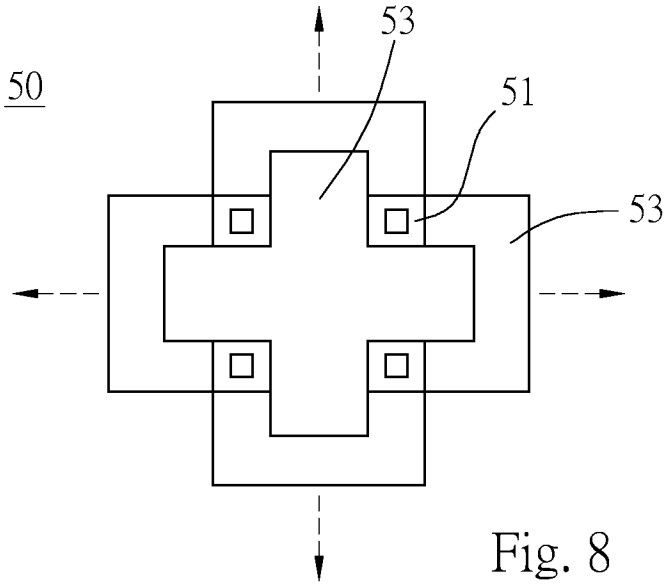
FIG. 8 is a partial top view of FIG. 7.
Figure 9:
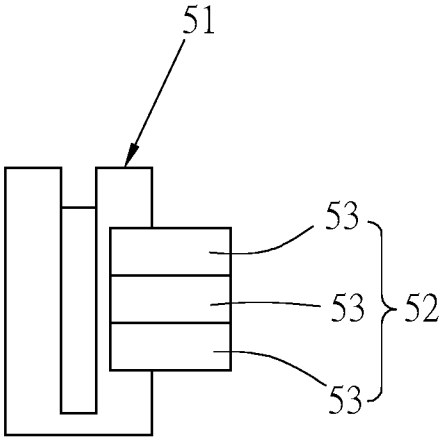
FIG. 9 is a partial side view of FIG. 7.
Figure 10:
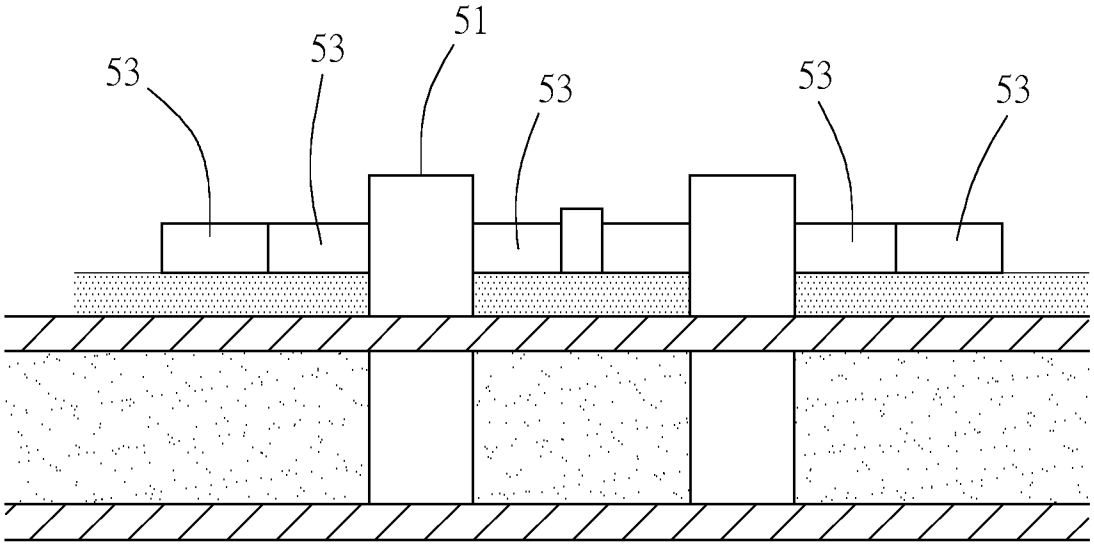
FIG. 10 is a schematic view of the road space tailoring mechanism, and showing a mode in an unfolded position.

As shown in FIG. 7 to FIG. 12, the road space tailoring mechanism 50 is installed on a seafront or a coast, and has a body 51 and a road module 52, wherein the body 51 is in the shape of a column for erecting the road module 52, and the road module 52 comprises a plurality of plates 53, according to an assembled mode of the plates 53, the assembled mode is divided into a storage position (as shown in FIGS. 7 to FIG. 9) and an unfolded position (as shown in FIG. 10 to FIG. 12).

When a tide or a flood exceeds a predetermined capacity, the road module 52 will be dismantled, so that the plates 53 are positioned in the unfolded position to provide more space for a water body to flow under the road module 52; after the tide or the flood has withdrawn, the plates 53 will be reassembled to position in the storage position.

In particular, the design idea of the road space tailoring mechanism 50 is derived from the principle of water regulation at the roots of trees during the dry season and the wet season.

The above-mentioned embodiments are merely used to illustrate the technical ideas and features of the invention, with an object to enable any person having ordinary skill in the art to understand the technical content of the invention and implement it accordingly, the embodiments are not intended to limit the Claims of the invention, and all other equivalent changes and modifications completed based on the technical means disclosed in the invention should be included in the Claims covered by the invention.

What is claimed is:

1. A tailoring yearn system having a tailoring mechanism, the tailoring mechanism comprising:

a first unit having an arc-shaped first arcuate portion; and a second unit having an arc-shaped second arcuate portion;

wherein the first unit and the second unit stagger each other with concave arcuate surfaces facing toward opposite directions by a center axis of curvature of the first arcuate portion parallelling to a center axis of curvature of the second arcuate portion to cause an arcuate end of the first arcuate portion locate between two arcuate ends of the second arcuate portion and separated from the concave arcuate surface of the second arcuate portion by a first distance, and to cause an arcuate end of the second arcuate portion locate between two arcuate ends of the first arcuate portion and separated from the first arcuate portion by a second distance, thereby the first arcuate portion and the second arcuate portion jointly define a curved channel between each other;

wherein the first arcuate portion has a plurality of first columns, and the first columns are spaced apart from one another and arranged in an arcuate shape of the first arcuate portion; the second arcuate portion has a plurality of second columns, and the second columns are spaced apart from one another and arranged in an arcuate shape of the second arcuate portion.

2. The tailoring yearn system as claimed in claim 1, wherein each of the first columns and each of the second columns are respectively quadrilateral in cross-sectional shape in a radial direction.

3. The tailoring yearn system as claimed in claim 2, wherein each of the first columns and each of the second columns are respectively trapezoidal in cross-sectional shape in a radial direction.

4. A tailoring yearn system, having a flood guiding array comprising the tailoring mechanism as claimed in claims 3.

5. The tailoring yearn system as claimed in claim 4, wherein the tailoring mechanisms are radially equidistantly disposed with a virtual center point as a center within a predetermined radius range with the center point as the center, and one end of the curved channel of each of the tailoring mechanisms is close to the center point, and another end is away from the center point.

6. The tailoring yearn system as claimed in claim 5, wherein a quantity of the tailoring mechanism is three.

7. The tailoring yearn system as claimed in claim 6, wherein a minimum distance between one end of any two of the adjacent second arcuate portions of the tailoring mechanisms close to the center point is a third distance.

8. The tailoring yearn system as claimed in claim 7, wherein one end of the curved channel close to the center point is defined as an inflow end, and another end of the curved channel away from the center point is defined as an outflow end.

9. The tailoring yearn system as claimed in claim 4, wherein two ends of the curved channel are respectively defined as an inflow end and an outflow end, the tailoring mechanisms are arranged one by one sequentially, and between any two of the adjacent tailoring mechanisms, the outflow end of the tailoring mechanism preceding sequentially is connected in series with the inflow end of the subsequent tailoring mechanism.

10. The tailoring yearn system as claimed in claim 9, wherein between any two of the adjacent tailoring mechanisms, one end of the second arcuate portion of the tailoring mechanism preceding sequentially located at another end of an arcuate shape of the outflow end is located in the inflow end of the curved channel of the subsequent tailoring mechanism, and one end of the first arcuate portion of the subsequent tailoring mechanism located at another end of an arcuate shape of the inflow end is located in the outflow end of the curved channel of the tailoring mechanism preceding sequentially, and the curved channel of the tailoring mechanism preceding sequentially and the curved channel of the subsequent tailoring mechanism are partially overlapped and communicated with each other.

11. The tailoring yearn system as claimed in claim 9, wherein a minimum distance between any two of the adjacent tailoring mechanisms is a fourth distance.

12. A tailoring yearn system, having a flood guiding array comprising the tailoring mechanism as claimed in claims 2.

13. The tailoring yearn system as claimed in claim 12, wherein the tailoring mechanisms are radially equidistantly disposed with a virtual center point as a center within a predetermined radius range with the center point as the center, and one end of the curved channel of each of the tailoring mechanisms is close to the center point, and another end is away from the center point.

14. The tailoring yearn system as claimed in claim 13, wherein a quantity of the tailoring mechanism is three.

15. The tailoring yearn system as claimed in claim 14, wherein a minimum distance between one end of any two of the adjacent second arcuate portions of the tailoring mechanisms close to the center point is a third distance.

16. The tailoring yearn system as claimed in claim 15, wherein one end of the curved channel close to the center point is defined as an inflow end, and another end of the curved channel away from the center point is defined as an outflow end.

17. The tailoring yearn system as claimed in claim 12, wherein two ends of the curved channel are respectively defined as an inflow end and an outflow end, the tailoring mechanisms are arranged one by one sequentially, and between any two of the adjacent tailoring mechanisms, the outflow end of the tailoring mechanism preceding sequentially is connected in series with the inflow end of the subsequent tailoring mechanism.

18. The tailoring yearn system as claimed in claim 17, wherein between any two of the adjacent tailoring mechanisms, one end of the second arcuate portion of the tailoring mechanism preceding sequentially located at another end of an arcuate shape of the outflow end is located in the inflow end of the curved channel of the subsequent tailoring mechanism, and one end of the first arcuate portion of the subsequent tailoring mechanism located at another end of an arcuate shape of the inflow end is located in the outflow end of the curved channel of the tailoring mechanism preceding sequentially, and the curved channel of the tailoring mechanism preceding sequentially and the curved channel of the subsequent tailoring mechanism are partially overlapped and communicated with each other.

19. The tailoring yearn system as claimed in claim 17, wherein a minimum distance between any two of the adjacent tailoring mechanisms is a fourth distance.

20. A tailoring yearn system, having a flood guiding array comprising the tailoring mechanism as claimed in claims 1.

21. The tailoring yearn system as claimed in claim 20, wherein the tailoring mechanisms are radially equidistantly disposed with a virtual center point as a center within a predetermined radius range with the center point as the center, and one end of the curved channel of each of the tailoring mechanisms is close to the center point, and another end is away from the center point.

22. The tailoring yearn system as claimed in claim 21, wherein a quantity of the tailoring mechanism is three.

23. The tailoring yearn system as claimed in claim 22, wherein a minimum distance between one end of any two of the adjacent second arcuate portions of the tailoring mechanisms close to the center point is a third distance.

24. The tailoring yearn system as claimed in claim 23, wherein one end of the curved channel close to the center point is defined as an inflow end, and another end of the curved channel away from the center point is defined as an outflow end.

25. The tailoring yearn system as claimed in claim 20, wherein two ends of the curved channel are respectively defined as an inflow end and an outflow end, the tailoring mechanisms are arranged one by one sequentially, and between any two of the adjacent tailoring mechanisms, the outflow end of the tailoring mechanism preceding sequentially is connected in series with the inflow end of the subsequent tailoring mechanism.

26. The tailoring yearn system as claimed in claim 25, wherein between any two of the adjacent tailoring mechanisms, one end of the second arcuate portion of the tailoring mechanism preceding sequentially located at another end of an arcuate shape of the outflow end is located in the inflow end of the curved channel of the subsequent tailoring mechanism, and one end of the first arcuate portion of the subsequent tailoring mechanism located at another end of an arcuate shape of the inflow end is located in the outflow end of the curved channel of the tailoring mechanism preceding sequentially, and the curved channel of the tailoring mechanism preceding sequentially and the curved channel of the subsequent tailoring mechanism are partially overlapped and communicated with each other.

27. The tailoring yearn system as claimed in claim 25, wherein a minimum distance between any two of the adjacent tailoring mechanisms is a fourth distance.

* * * * *